United States Patent [19]

Franzosi

[11] 3,993,219

[45] Nov. 23, 1976

[54] METERING AND MIXING APPARATUS FOR A PLURALITY OF LIQUIDS

[75] Inventor: Mario Carlos Franzosi, Cordoba, Argentina

[73] Assignees: Jose Francisco Franzosi; Alberto Lorenzo Franzosi, both of Cordoba, Argentina; part interest to each

[22] Filed: Jan. 20, 1976

[21] Appl. No.: 650,598

[30] Foreign Application Priority Data

Jan. 24, 1975 Argentina ..... 257414

[52] U.S. Cl. ..... 222/56; 222/67; 222/134; 222/139; 222/145

[51] Int. Cl.[2] ..... B67D 5/14; B67D 5/60

[58] Field of Search ..... 222/56, 67, 139, 135, 222/145, 134, 148

[56] References Cited

UNITED STATES PATENTS

| | | | |
|---|---|---|---|
| 748,971 | 1/1904 | Millspaugh | 222/134 |
| 2,511,637 | 6/1950 | Johannes | 222/56 |

*Primary Examiner*—Allen N. Knowles
*Assistant Examiner*—Hadd Lane
*Attorney, Agent, or Firm*—Ladas, Parry, Von Gehr, Goldsmith & Deschamps

[57] ABSTRACT

An apparatus is provided for mixing metered quantities of a plurality of liquids in accurately constant proportions according to a continuous process. The apparatus comprises one storage tank for each of the liquids which must be mixed, each storage tank being provided with an inlet conduit and an outlet conduit, the output of the inlet conduit and the input of the outlet conduit being axially aligned one opposite the other within the corresponding tank, each of said outlet conduits having a liquid pump and a metering orifice one of which is fixed and the other or others being micrometrically adjustable, all said liquid pumps being driven by a single and the same motive power source, each storage tank having a float therein capable of controlling an inlet valve inserted in the corresponding inlet conduit. A more sophisticated embodiment includes an additional tank also having inlet and outlet conduits whose respective output and input are axially aligned one opposite the other, the output of said metering orifices being connected to a mixer section the output of which is connected to said inlet conduit of said additional tank, the outlet conduit of the latter being connected to the intake of an additional liquid pump the exhaust of which includes a final product discharge valve controllable by an hydraulic control valve actuatable by a float provided within said additional tank thus controlling the output of final product in accordance with the liquid level in the additional tank.

18 Claims, 11 Drawing Figures

FIG. 2
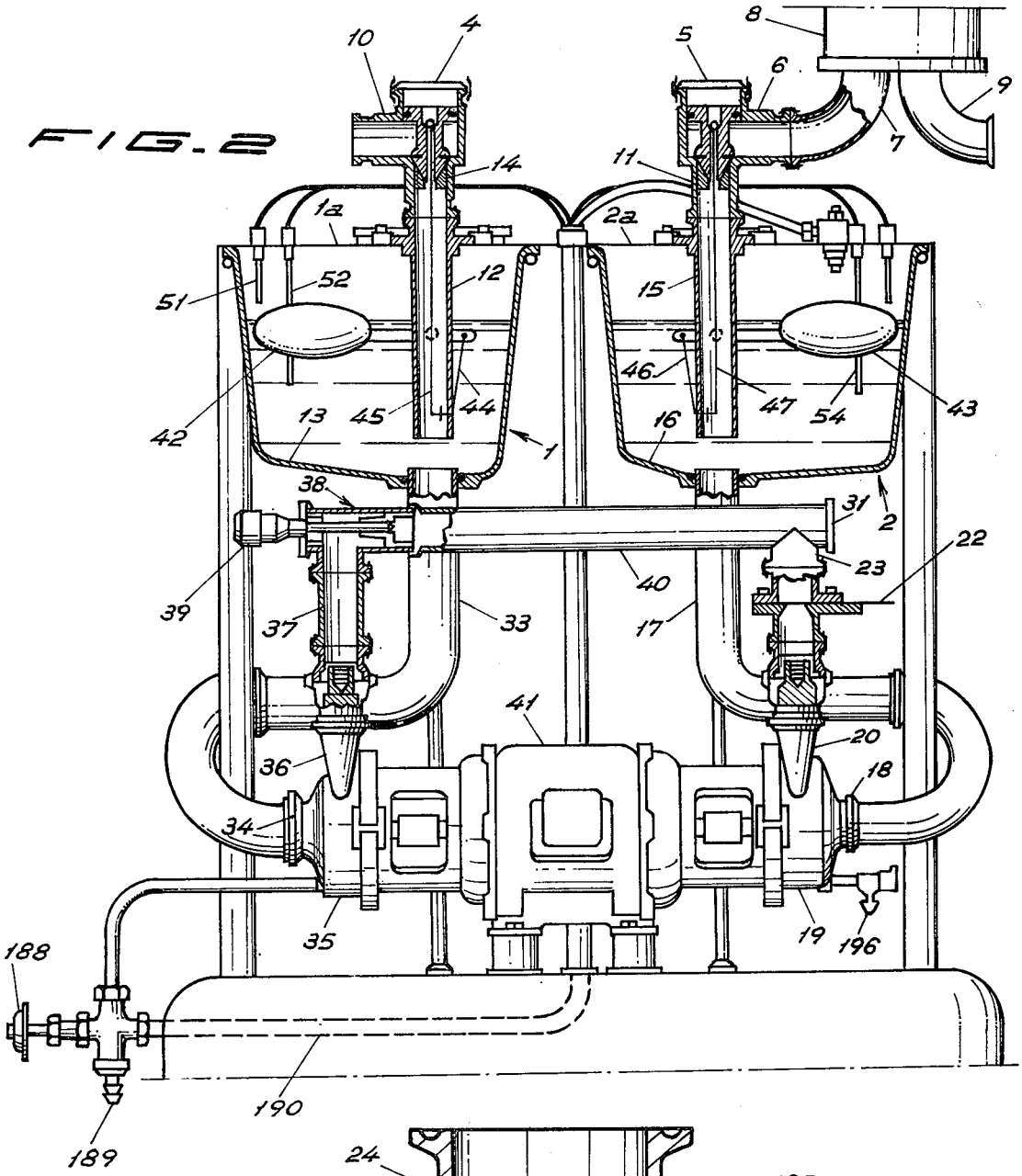
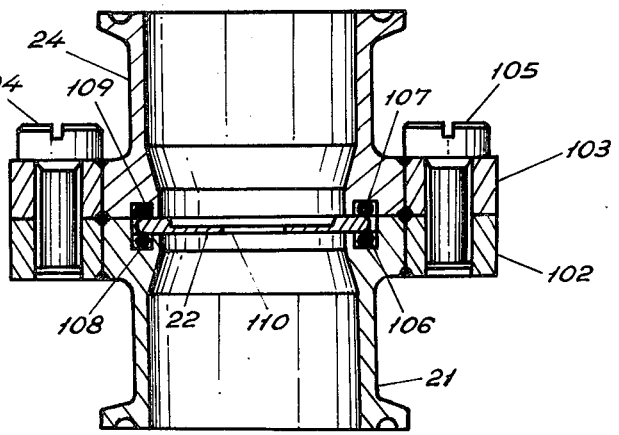
FIG. 5

METERING AND MIXING APPARATUS FOR A PLURALITY OF LIQUIDS

BACKGROUND OF THE INVENTION

1. Field of the Invention

In some industrial and technical applications it is necessary to mix two or more liquids, each in the most exact possible proportion with respect to the others and in certain fields, like the pharmaceutical products industry and certain chemical operations involving reactions in which are critical the proportions of the reagents partaking in the reaction, the proportions must be maintained within minimum tolerances which can not be exceeded without the risk of having to discard the production.

When the batch mixing process is used, there is practically no problem of maintaining constant the proportions of the components of the batch, since it is comparatively easy to measure or weigh each of the components within minimum tolerances by methods already known in the art.

But when a continuous process is used, the problem may become really serious, since it is considerably more difficult to maintain constant the proportions of the components of the mixture during relatively long periods of operation of the machine.

It has already been proposed in the art to use a mixing apparatus, for at least two fluid components, which is provided with two storage tanks, one for each component, the respective liquid component being introduced in the storage tank until a certain level is reached, the liquidflowing by gravity from each tank to a mixer tank arranged below said storage tanks. Notwithstanding, the differences of level in the storage tanks, caused by the discharge of liquid from each tank and the replacement of the spent liquid, produce variations of the respective hydrostatics heads and thus introduce variations in the discharge flow rate from each storage tank; the mixture discharged from the mixer tank thus has a composition varying with time within limits which can be narrow comparatively considered, but which can be excessive in certain applications where a high accuracy is required. Another source of disturbance of the flow rates is the turbulence produced by the simultaneous charging and discharging of fluid into and from each storage tank.

This requires a continuous watch of the resulting composition and frequent manual readjustments in spite of which it can be necessary to discard some portions of the production, with the consequent economic losses.

One of the objects of this invention is to provide a metering and mixing apparatus for a plurality of liquids which, continuously operating, will maintain constant the proportions of the component liquids of the final mixture within considerably narrower limits than what is obtainable with the prior art apparatus.

A further object is to provide an apparatus of the kind mentioned that avoids turbulences in the liquid within each tank.

Another object is to provide an apparatus of the kind mentioned that is capable of maintaining the level of the liquid in each storage tank within predetermined maximum and minimum limits.

Another object is to provide an apparatus of the kind mentioned that provides a more effective mixing action of the component liquids.

Another object is to provide an apparatus of the kind mentioned capable of maintaining accurately the proportions of the component liquids during the entire working period and at the same time allowing to operate with high flow rates, that is to say with high production rates.

Another object is to provide an apparatus of the kind mentioned which has a construction which allows an easy cleaning of its components.

Another object is to provide an apparatus of the kind mentioned having means allowing a highly accurate desired adjustment, by means of a micrometrical adjustment device, of the flow rate of at least one of the streams forming the final mixture.

SUMMARY OF THE INVENTION

These and other objects and advantages of the present invention are achieved providing a metering and mixing apparatus for a plurality of liquids each supplied from a respective source, the machine comprising a plurality of storage tanks, one for each of the liquids to be mixed; a first supply conduit for each of said tank means, each supply conduit having an inlet connected to a respective source of the corresponding liquid to be mixed, and an outlet discharging downwardly into the respective tank from the upper part thereof, said first conduit reaching down to a comparatively short distance from the tank bottom, and a second outlet conduit for each of said tanks and having an inlet and an outlet, this inlet being connected to the bottom of the corresponding tank substantially in axial alignment with the outlet of said first conduit, a liquid pump for each tank and having an intake and an exhaust, this intake being connected to the outlet of said corresponding second output conduit; a third discharge conduit for each of said pumps, said exhaust of each pump being connected to the inlet of the corresponding third discharge conduit which is provided with an outlet; a single fourth mixed product output conduit having a plurality of inlets each connected to one of the outlets of said third discharge conduits; an interchangeable metering orifice plate arranged within the flow path between one of said third conduits and said fourth conduit, said plate being interchangeably mounted to allow its replacement by other plates having metering orifices of different size, and a micrometrically adjustable metering orifice device arranged between each of the remaining third conduits and said fourth conduit, an intake control valve for each of said first conduits, a float arranged in each tank and mechanically linked to its corresponding intake control valve for closing said intake control valve when the liquid in said tank rises above a predetermined level, and a single drive means for all said liquid pumps.

While the apparatus of the present invention is useful in any process in which two or more liquids must be mixed in exactly metered proportions, as for example the manufacture of pharmaceutical products, various chemical processes, the hydrocarbon products industry and its derivatives, and many other industrial and technical fields, the present invention will now be described according to one of the preferred embodiments of an apparatus usable for manufacturing gaseous beverages like those comprising a mixture of a sirup and water as main components of the finally produced beverage.

BRIEF DESCRIPTION OF THE DRAWINGS

The invention can be better understood from the following description of one of its embodiments actually considered as preferable, which will be given only as an illustrative and not limitative example with reference to the accompanying drawings, in which:

FIG. 2 is a view similar to FIG. 1, but corresponding to a simplified embodiment of the apparatus of the present invention;

FIG. 5 is a side elevation cross-section showing the mounting of one of the interchangeable metering orifice plates;

DESCRIPTION OF THE PREFERRED EMBODIMENT

Figure 1:
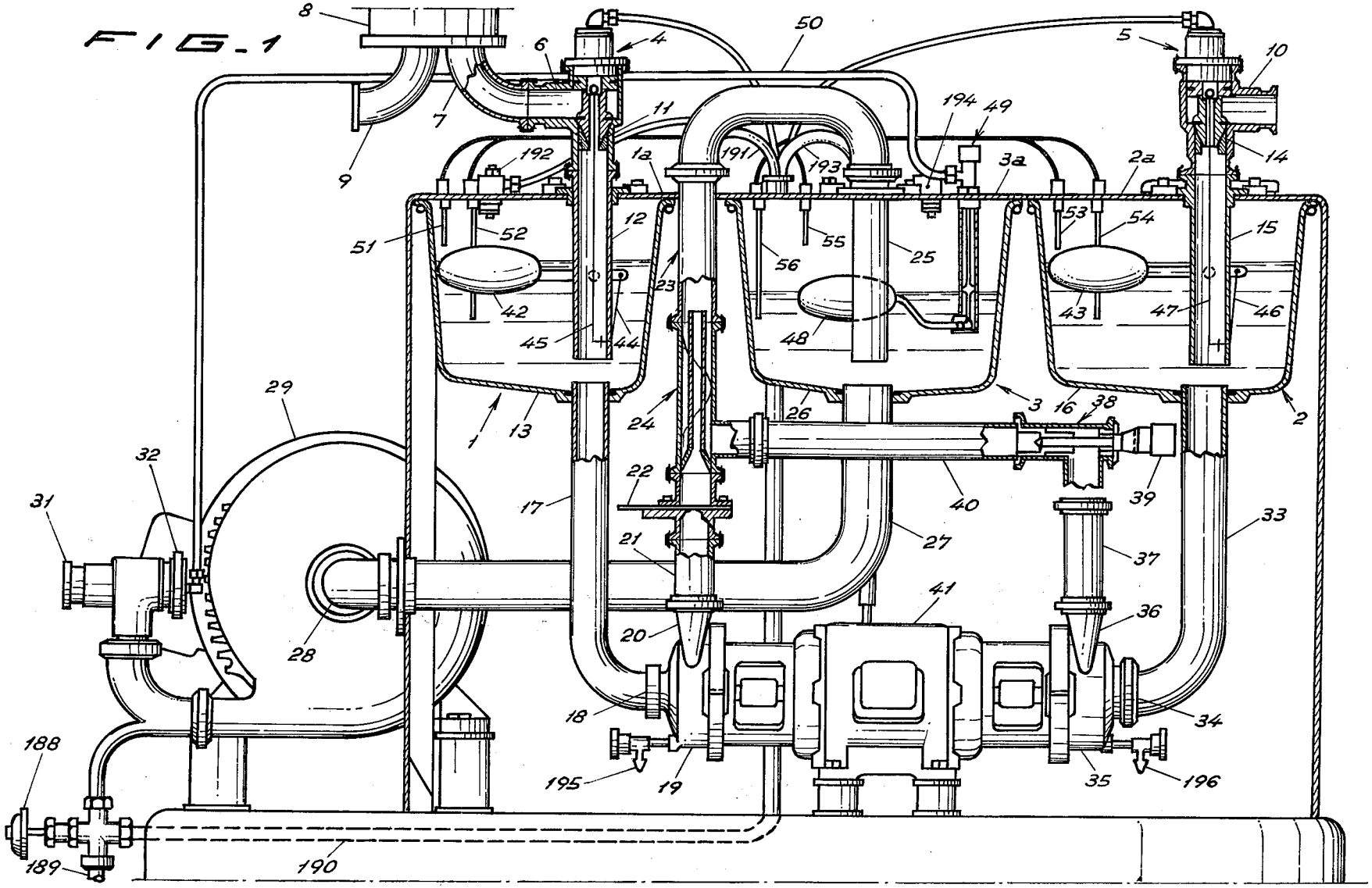
FIG. 1 is a schematic view of the apparatus of the present invention, with certain portions broken away.

In the various figures the same reference numbers have been used for the same or corresponding components. Referring now to FIG. 1 of the drawings, the apparatus of the present invention comprises two liquid storage tanks 1 and 2 which are substantially alike, and a third additional tank 3. The storage tanks 1 and 2 have each a corresponding intake control valve 4 and 5. The input 6 of valve 4 is connected to the output 7 of a filter 8 which has its input 9 connected to a reservoir (not illustrated) which contains one of the liquids to be mixed which, in the present case, will preferably be the one containing the sirup.

The input 10 of the intake control valve 5 is connected to another reservoir (not illustrated) containing the other liquid to be mixed, and which in the present case will preferably be the one containing water.

The output 11 of valve 4 extends downwardly forming a conduit 12 which enters through the upper part 1*a* of storage tank 1 and extends therein down to a relatively short distance from its bottom 13. The output 14 of valve 5 extends downwardly forming a conduit 15 which enters through the upper part 2*a* of storage tank 2 and extends therein down to a relatively short distance from its bottom 16.

The bottom 13 of storage tank 1 is provided, at its lowest part, with a conduit 17 the upper end of which leads into said tank almost flush with its bottom 13, its lower end 18 being connected to the intake of a centrifugal pump 19, its exhaust 20 extending into a conduit 21 in which is inserted, within the flow path of the liquid, a device comprising a plate 22 which has a calibrated metering orifice. The conduit 21, after the metering orifice plate, extends into a conduit 23, comprising a mixer section 24, finally entering the additional tank 3 through the upper part 3*a* thereof, a portion 25 extending downwardly into the tank down to a comparatively short distance of the bottom 26 thereof.

The bottom 26 of additional tank 3 is provided at its lowest part, with a conduit 27 the upper end of which leads into said tank almost flush with its bottom 26, its other end being connected to the intake 28 of an additional centrifugal pump 29, its exhaust 30 ending in a final product output conduit 31, the supply flow rate being controllable by a final product flow rate valve 32.

The bottom 16 of tank 2 is provided, at its lowest part, with a conduit 33 the upper end of which leads into said tank almost flush with its bottom 16, its lower end 34 being connected to the intake of a centrifugal pump 35 (identical to pump 19), its exhaust 36 extending into a conduit 37 connected to the input of a metering orifice device of adjustable aperture 38 allowing the adjustment of the flow rate by means of a micrometrical screw 39. The output of device 38 extends into conduit 40 the other end of which discharges into the mixer section 24 of conduit 23, so that in this section the corresponding liquid streams supplied by pumps 19 and 35 form a single stream which discharge into additional tank 3 through conduits 23 and 25.

It must be noted here that a very important feature of this invention is that pumps 19 and 35 are identical (that is to say, they are capable of supplying identical flow rates when operating at identical r.p.m.) and that both pumps, to obtain substantially identical performances, have their rotors connected to the power shaft of the same driving motor 41 which in the present case is an electric motor. Not withstanding, it will be understood that pumps 19 and 35 could be driven also by another kind of motive power source, under the sole condition that both rotors will be driven at exactly the same r.p.m.

Within each storage tank 1 and 2 there is provided a corresponding float 42 and 43 which, through linkages 44 and 45, and 46 and 47, respectively (these linkages will be better described later on), operate the intake control valves 4 and 5. The additional tank 3 has a float 48 which controls an hydraulic control valve 49 which, through hydraulic control fluid conduit 50, is connected to the final product flow rate control valve 32, controlling its operation.

The storage tank 1 is provided with an electrode 51 controlling the maximum liquid level in said tank and with an electrode 52 controlling the minimum liquid level therein; similarly, storage tank 2 is provided with corresponding electrodes 53 and 54, and additional tank 3 is provided with corresponding electrodes 55 and 56.

FIG. 2 shows a simplified embodiment of the apparatus of this invention which, in many respects is similar to the apparatus of FIG. 1. In FIG. 2 the same reference numbers of FIG. 1 have been used to designate same or equivalent parts.

Thus, only the parts of the apparatus which are different from those used in the embodiment of FIG. 1 will be described here. It will be noted that in this specified embodiment the additional tank 3, the mixer section 24, the additional centrifugal pump 29, the final product output flow rate valve 32 and the hydraulic control valve 49 and its hydraulic control fluid conduit 50 have been omitted. While intake control valves 4 and 5 are used, they are only manually actuatable but not by remote hydraulic control. It can be noted that conduits 21 and 37 are provided with their respective metering orifice devices 22 and 38 and that the latter is also provided with the micrometrically adjustable means 39. Conduits 40 and 23 are directly connected one to the other and provide through 31 the final product.

The other parts illustrated in FIG. 2 are identical to the parts used in the embodiment of FIG. 1.

Figure 3:
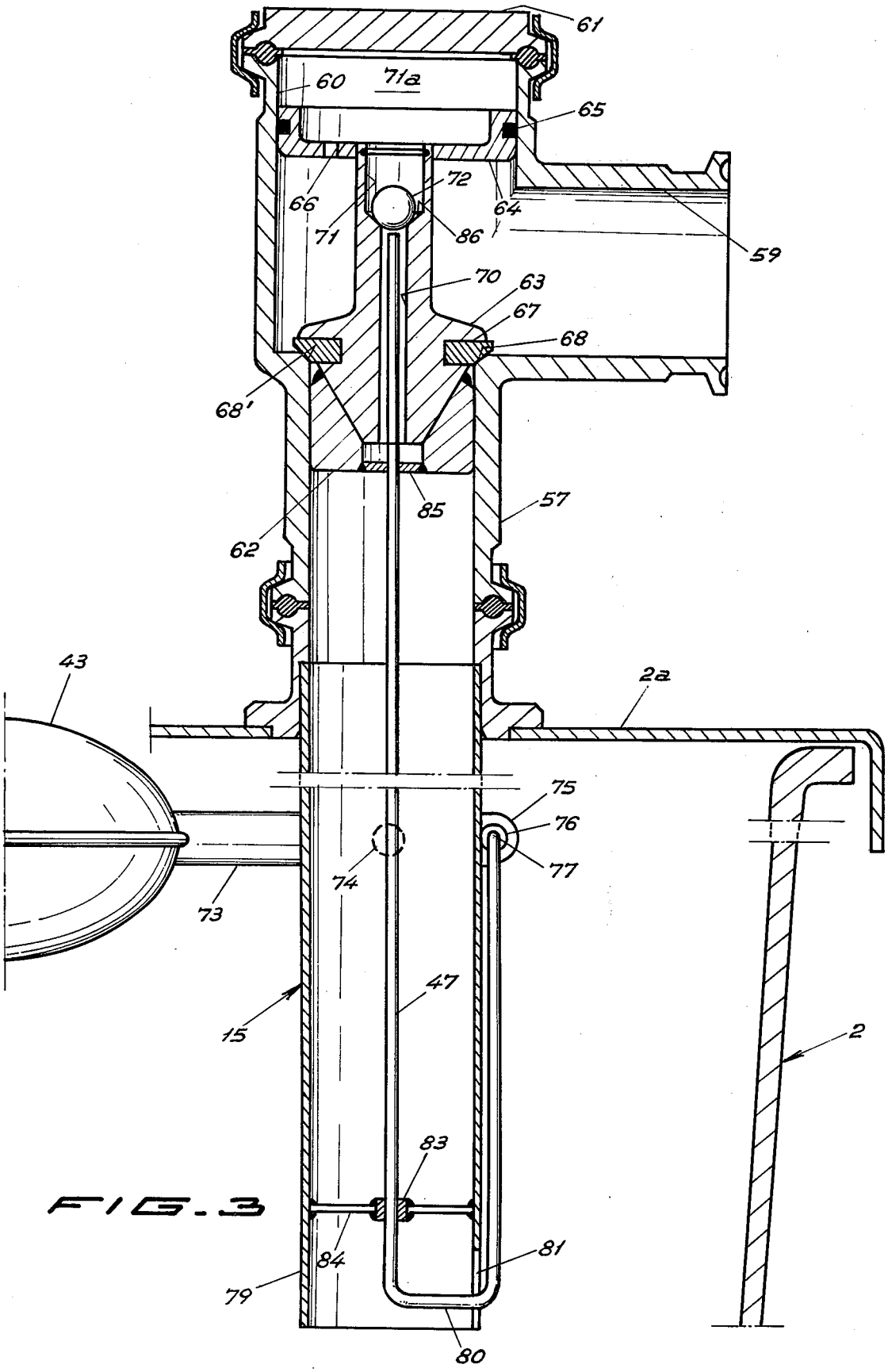
FIG. 3 is a side elevation cross-section showing the construction of a preferred embodiment of an intake control valve of a storage tank.

FIG. 3 shows a side elevation cross-sectioon of a valve like valve 5 shown in FIG. 2 and valve 4 is of course of identical construction. This valve comprises a body 57 which is an extension of the upper part of conduit 15, the body 57 being above the upper end 29 of storage tank 2. Body 57 has an input 59 and has at its upper end 60 a cover 61. Body 57, below the input 59, is provided with a conical seat 62 on which is seatable a valve member 63 having at its upper part a piston 64 which has a sealing ring 65 annd a through-passage 66.

The valve member 63 has also a sealing ring 67 allowing its sealing closure on edges 68 and 68' defined by an enlargement 69 of the upper part of the body 57.

Through valve member 63 runs an axial channel 70 and has at its upper end a chamber 71 within which there is provided a valve ball 72 seatable on the edges of channel 70 where it leads to chamber 71. Within the storage tank 2, as has been mentioned above, there is provided a float 43 mounted on an arm 73 which is rotatively mounted on conduit 15 at 74 and the other end 75 of arm 73 has an opening 76 into which is introduced the bended end 77 of rod 46' extendinng substantially down to the lower end 79 of conduit 15, and a bend 80 of the rod passes through a cutting 81 of said lower end 79 extending within conduit 15 and bending again through 90° extending upwards as an ascending branch 47 guided by a guiding ring 83 fixed to the inner wall of conduit 15 at 84. The upper end of branch 47 go through a guide 85 and extends within channel 70 ending at a minimum distance of valve ball 72 (but without touching it) when float 43 has been raised when the liquid in tank 2 has reachd its maximum desired level. In FIG. 3 it can be clearly seen that if float 43 goes down because the liquid level has lowered in tank 2, branch 47 of the rod will move upwards within conduit 15 and channel 70 pushing up the valve ball 72 lifting it off its seat 86, thus opening channel 70 to chamber 71*a* located between the upper face of piston 64 and the lower face of cover 61.

FIG. 3-A shows a side elevation cross-section of a valve like valve 5 of FIG. 1. This valve has a construction similar to that of the valve of FIG. 3, with the only difference that cover 61 has been replaced by a device actuatable by fluid pressure which allows the mannual remote closure control of the valve. Since its construction is entirely similar to that of the valve of FIG. 3 from the lower end of conduit 15 to the upper end, where in the case of FIG. 3 the cover 61 is provided, the same reference numbers have been used in FIG. 3A for all the parts that are identical with the parts of the embodiment of FIG. 3 and which perform the same functions. Thus, only the parts of the valve that are new with respect to FIG. 3 will be described here in detail.

Figure 3A:
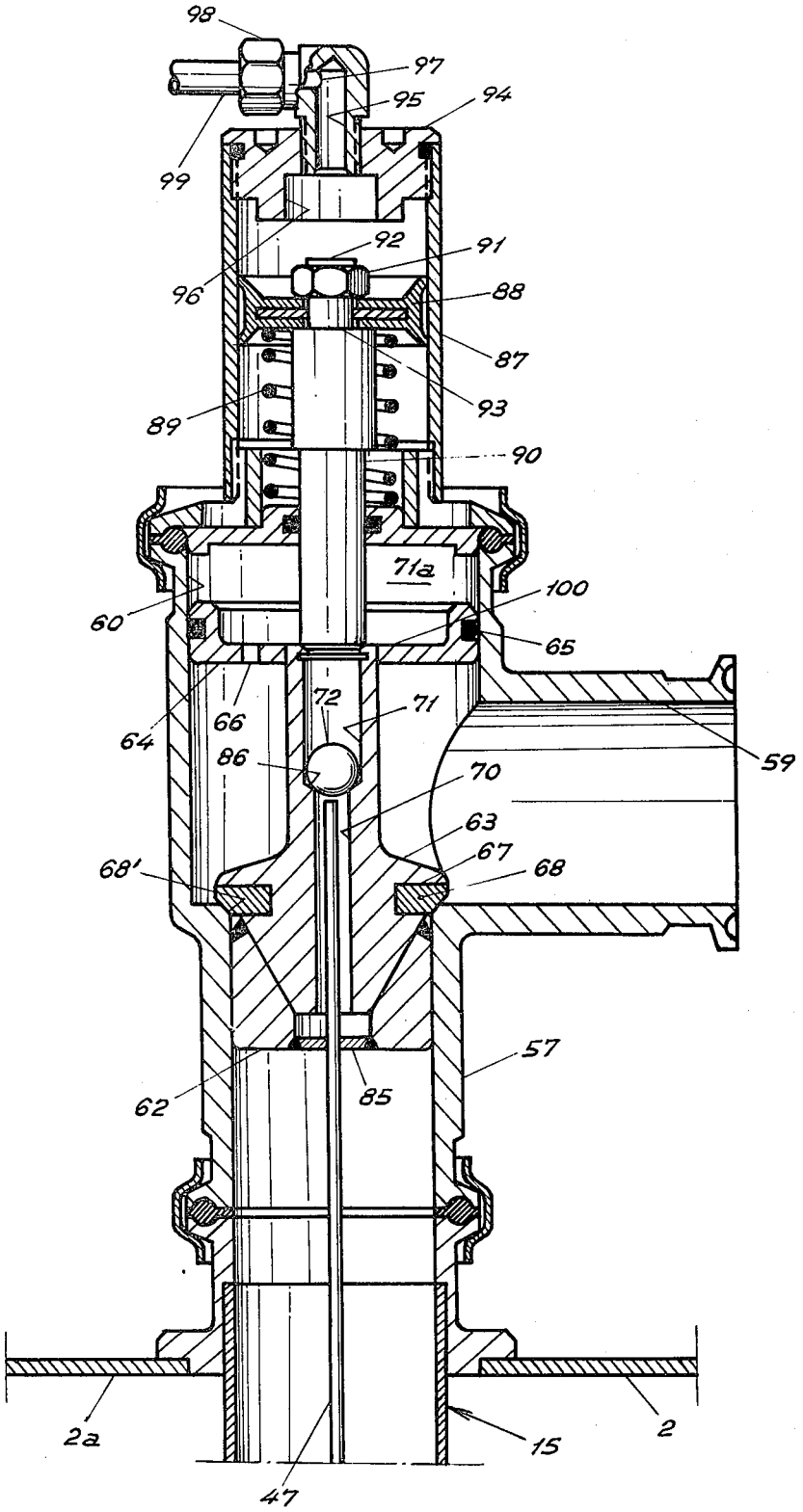
FIG. 3A is a cross-section similar to FIG. 3, but showing another embodiment of the valve which is controllable by pressurized fluid.

As can be noted in FIG. 3A, the valve of this embodiment is provided, at its upper end, with a cylinder 87 within which is slidably movable a piston 88 which is normally biased towards the upper part of cylinder 87 by a compression spring 89. Piston 88 is provided with a piston rod 90 fixed to the piston by means of a nut 91 screwed onto the threaded upper end 92 of piston rod 90, and abutting with a shoulder 93 provided by an enlargement of the piston rod.

The upper end of the cylinder is sealed by a cover 94 provided with an axial conduit 95 the lower end 96 of which opens into the cylinder 87, the conduit 95 extending into a branch 97 at 90° to conduit 95. To the end of branch 97 a fitting 98 is connected allowing the coupling of one of the ends of a control fluid line 99 (see also FIG. 1) to the corresponding remote control means (not shown).

The lower end of piston rod 90 has a diameter which is slightly less than the inner diameter of chamber 71 allowing its seating onto the upper face 100 of piston 64. Thus it will be understood that when the piston rod 90 is pushed downwardly by piston 88, it will push also downwardly the piston 64 thus also carrying downwardly the valve member 63 seating it onto the seat edge 68–68'.

Figure 4:
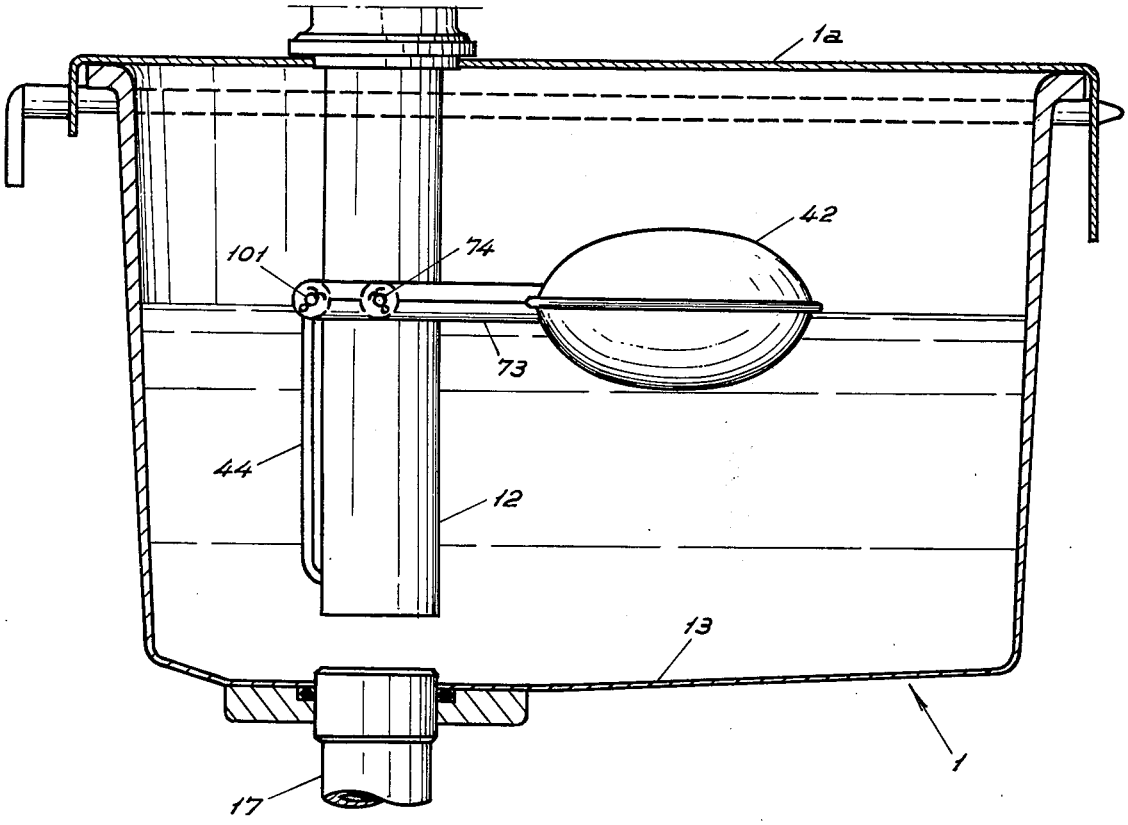
FIG. 4 is a side elevation cross-section of one of the storage tanks showing the mounting of the corresponding float.

FIG. 4 shows a storage tank, in the present case tank 1, seen from the rear with respect to FIG. 1, better showing the mounting of float 42 on conduit 12 by means of the pivot 74, as well as the rotative coupling 101 between the float arm 73 and the rod 44 the lower end of which enters into conduit 12.

FIG. 5 shows the mounting of a metering orifice plate 22 within the flow path betwen conduit 21 and the mixer section 24 (see also FIG. 1), to allow the establishment of exact proportions of the liquid which must be feeded from storage tank 1, said proportion varying according to the properties and characteristics of the liquid which must be fed, said plate being interchangeable with other plates that are similar but each provided with a metering orifice of a different size.

Having available an enough assorted stock of plates 22 with metering orifices of different diameters which are within an ample range, it will be possible to adapt the apparatus at any moment for the production of any product which will have the desired proportions of the component liquids without it being necessary to change the relative speeds of rotation of pumps 19 and 35. As can be seen in FIG. 5, the arrangement for fitting the metering orifice plate comprises the upper end of conduit 21 extending from pump 19 and the lower end of the mixer section 24. Conduit 21 has a flange 102 while the mixer section has a flange 103, both flanges being connectable together by means of screws 104 and 105. On the face of flange 102 there is provided a circular groove 106 and on the face of flange 103 there is provided a circular groove 107. When both flanges are connected together and are axially aligned, groove 106 will be exactly opposite to groove 107, thus forming a circular channel capable of receiving a lower sealing ring 108 housed in groove 106 and an upper sealing ring 109 housed in groove 107. Between these sealing rings the metering orifice plate 22 will be introduced, the plate being provided with a central orifice 110 having a diameter calibrated with great accuracy to allow an exactly predetermined flow rate.

Figure 6:
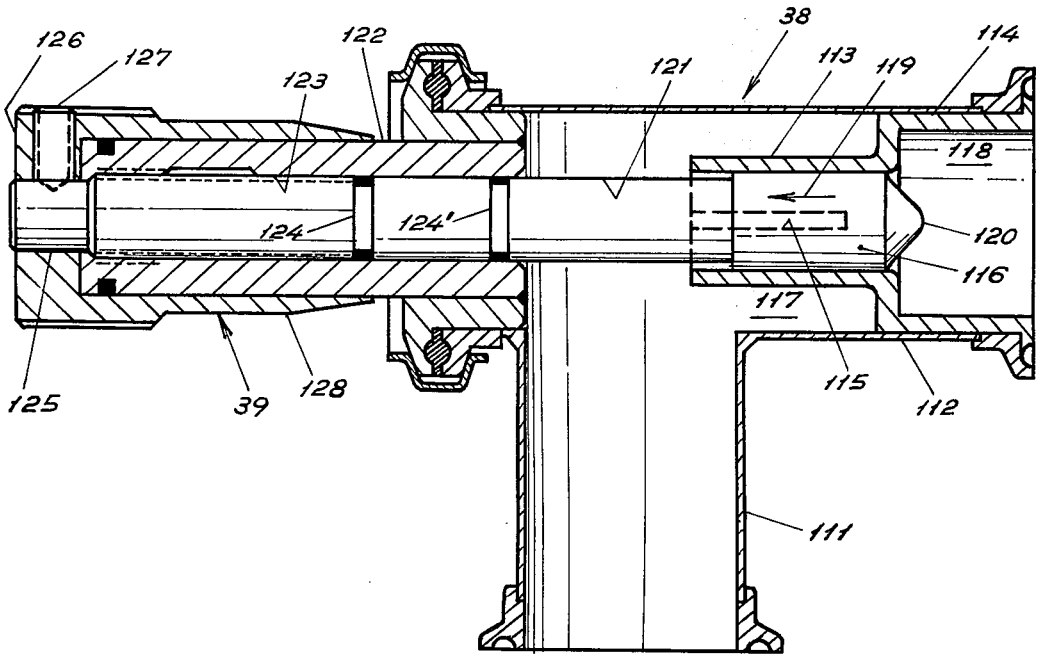
FIG. 6 is a side elevation cross-section showing the metering orifice of variable area controllable by a micrometrically adustable device.

FIG. 6 shows a side elevation cross-section of the metering orifice device having a micrometrically adjustable aperture 38 (see also FIG. 1). This device comprises conduit 111 which is an extension of conduit 37 coming from pump 35, and being connected at an angle of 90° to conduit 112 coupled to conduit 40 which feeds the mixer section 24. The metering orifice arrangement comprises a cylindrical sleeve 113 having a substantially less outside diameter than the inside diameter of conduit 112 and mounted within this conduit by means of an enlarged diameter portion 114 fixed to the inner wall of conduit 112. The circular wall of sleeve 113 has at least one longitudinal slot 115. Within sleeve 113 is slidably mounted a plunger 116 which is longitudinally adjustable and which, when introduced within sleeve 113, covers slot 115 in such a manner that it prevents the flow therethrough of liquid from space 117 to space 118. By means of the micrometrical screw mechanism which will be described later, the plunger is longitudinally slidable within sleeve 113 in a very gradual and accurately adjustable manner. Thus, as the plunger is slided in the direction indicated by arrow 119, away from the closing position illustrated in FIG. 6, a point will be reached at which the plunger 116 will begin to discover a gradually greater portion of slot 115, thus allowing the flow of gradually greater and accurately controllable amounts of fluid from space 117 to space 118, that is (see FIG. 1) from pump 35 to the mixer section 24. The conical nose 120 of the plunger 116 secures that the initial discovering of slot 115 will be very gradual, allowing an accurate adjustment of comparatively small flow rates. If this would be desirable, sleeve 113 could have two or more slots like slot 115 equidistantly spaced onto the sleeve periphery, or it could also have a single helicoidal slot on said periphery.

To plunger 116 a plunge rod 121 is connected extending within a cylinder 122 fixed to the assembly of conduits 111 and 112. The end of plunger rod 121, opposite to the end carrying plunger 116, has an outer micrometrical screw thread 123 cooperating with an inner thread provided on the inner wall of cylinder 122. Plunger rod 121 is also provided with sealing packings 124 and 124' preventing the liquid from the interior of conduit 112 from leaking to the outside along the plunger rod. The end of the plunger rod 121 opposite to the end carrying plunger 116 has a narrower portion 125 on which is mounted a cap 126 the rotation of which, with respect to portion 125, is prevented by means of a set screw 127. Cap 126 has a skirt 128 capable of freely rotating and sliding over the external surface of cylinder 122. This external surface can bear conventional markings according to what is common practice with micrometrical screws.

Figure 7:
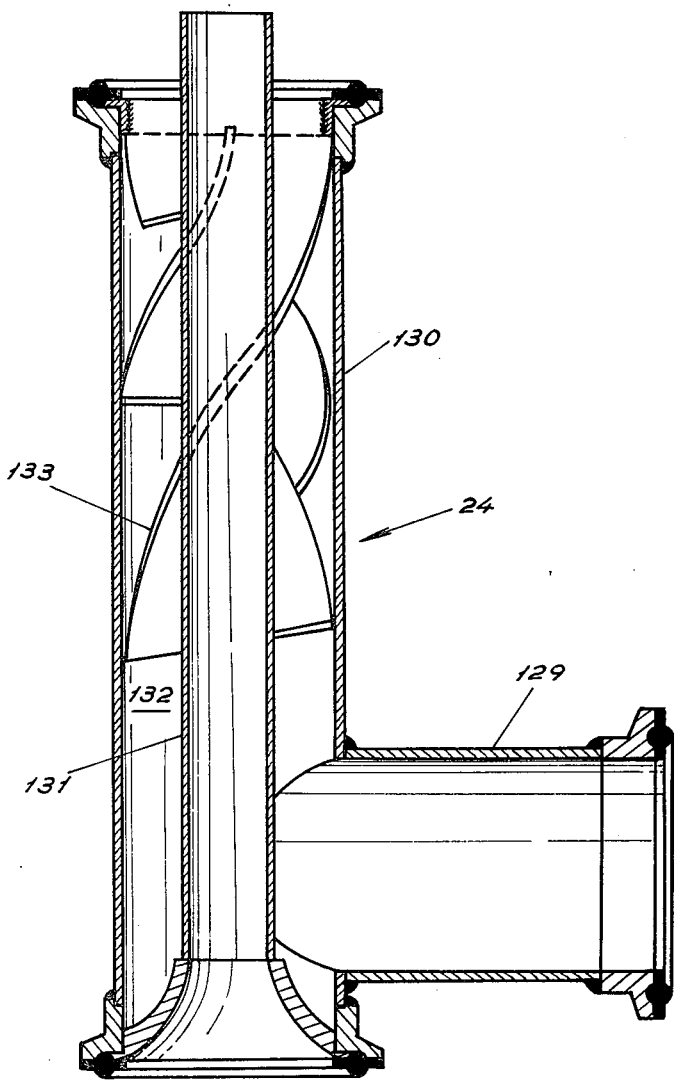
FIG. 7 is a side elevation cross-section showing the construction of the mixer section.

FIG. 7 shows a side elevation cross-section of the mixer section 24 (see also FIG. 1). This section comprises a conduit 129 coupled at 90° to another conduit 130 extending downwardly to be connected to conduit 21 through metering orifice device 22. Conduit 129 is connected to conduit 40 coming from micrometrically adjustable metering orifice device 38. The liquid pumped by pump 19 from storage tank 1 enters an inner conduit 131 coaxially mounted within conduit 130 thus forming a flow space 132 between conduits 130 and 131. Liquid pumped by pump 35 through conduit 37, micrometrically adjustable device 38, conduit 40 and conduit 129, discharges into conduit 130 thus flowing upwardly through said space 132. IN space 132 there are mounted helicoidally arranged blades 133 communicating to the liquid, flowing through space 132, a fast rotational movement so that, when the liquid rushes into conduit 23 from the upper part of space 132 it meets the liquid which leaves the upper end of the inner conduit 131 and, due to its fast rotational movement, produces a strong mixing action of both liquids, thus providing an homogeneous mixture.

Figure 8:
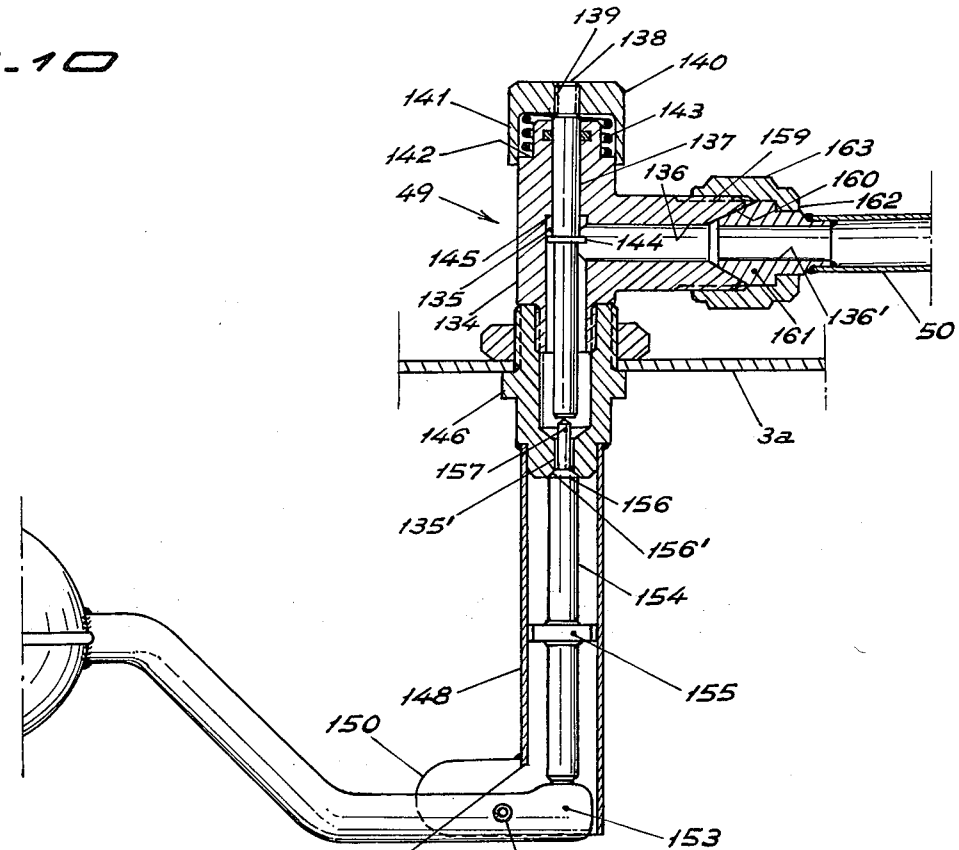
FIG. 8 is a side elevation cross-section of the hydraulic control valve remotely controlling the product output supplied by the corresponding pump.

FIG. 8 shows a side elevation cross-section of the hydraulic control valve 49 (see also FIG. 1). This valve comprises a body 134 having a longitudinal conduit 135 and a transversal conduit 136 which discharges into conduit 135 at 90° to the latter. Within the body 134 there is axially slidably arranged an actuating rod 137 with its upper end extending slightly outside the corresponding end of the longitudinal conduit 135. The upper end of the actuating rod has a portion of slightly lesser diameter 138 fixed within a central aperture 139 of a cap 140 having a skirt 141 which extends slidably downwardly over the body 134. Between cap 140 and a shoulder 142 of the upper portion of body 134 an helicoidal compression spring 143 is provided normally biasing cap 140 upwardly and thus also the rod 137. The upward movement of rod 137 is limited by an annular projection 144 fixed on the actuating rod and capable of abutting against a shoulder 145 of the longitudinal conduit 135. This latter extends downwardly through fitting 146 which allows the mounting of the valve assembly onto the cover 3a of additional tank 3 (see FIG. 1), said fitting 146 being connected to conduit 148 (see also FIG. 1), its lower end opening into tank 3. Lower end of conduit 148 has a lateral cutting 149 from which a lateral lug 150 extends, on said lug being pivotally mounted at 151 a mounting arm 152 of float 48. The end 153 of arm 152 controls a valve member 154 guided within conduit 148 by means of a projection 155 of said valve member 154 and slidably contacting the inner wall of conduit 148 and maintaining centered therein the valve member 154. The upper end of the valve member 154 has a conical portion 156 ending with a pushing projection 157 capable of contacting the lower end 158 of the actuating rod 137. On the end of conduit 136 there is provided an external screw thread 159 and the output is conical as indicated at 160 to receive a conical nipple 161 to which the hydraulic control conduit 50 is connectable (see also FIG. 1). The conical nipple 161 fits tightly within conical seat 160 by means of a cap 162 having a skirt 163 fixed on the exterior of conduit 136 by means of a complementary screw thread. As can be seen in FIG. 8, when float 48 moves upwardly because the liquid level rises in additional tank 3, the float arm 152 rotates about its pivot point 151 and its end 153 moves downwardly; thus valve member 154 also moves downwardly and its conical portion 156 loss contact with its seat 156'. Under these conditions, hydraulic control conduit 50 will be communicated with the interior of additional tank 3 through conduit 136', nipple 161, conduit 136, conduit 135, reduced diameter portion 135' of the lower end of the latter, conduit 148 and lower end of the latter and its cutting 149.

Figure 9:
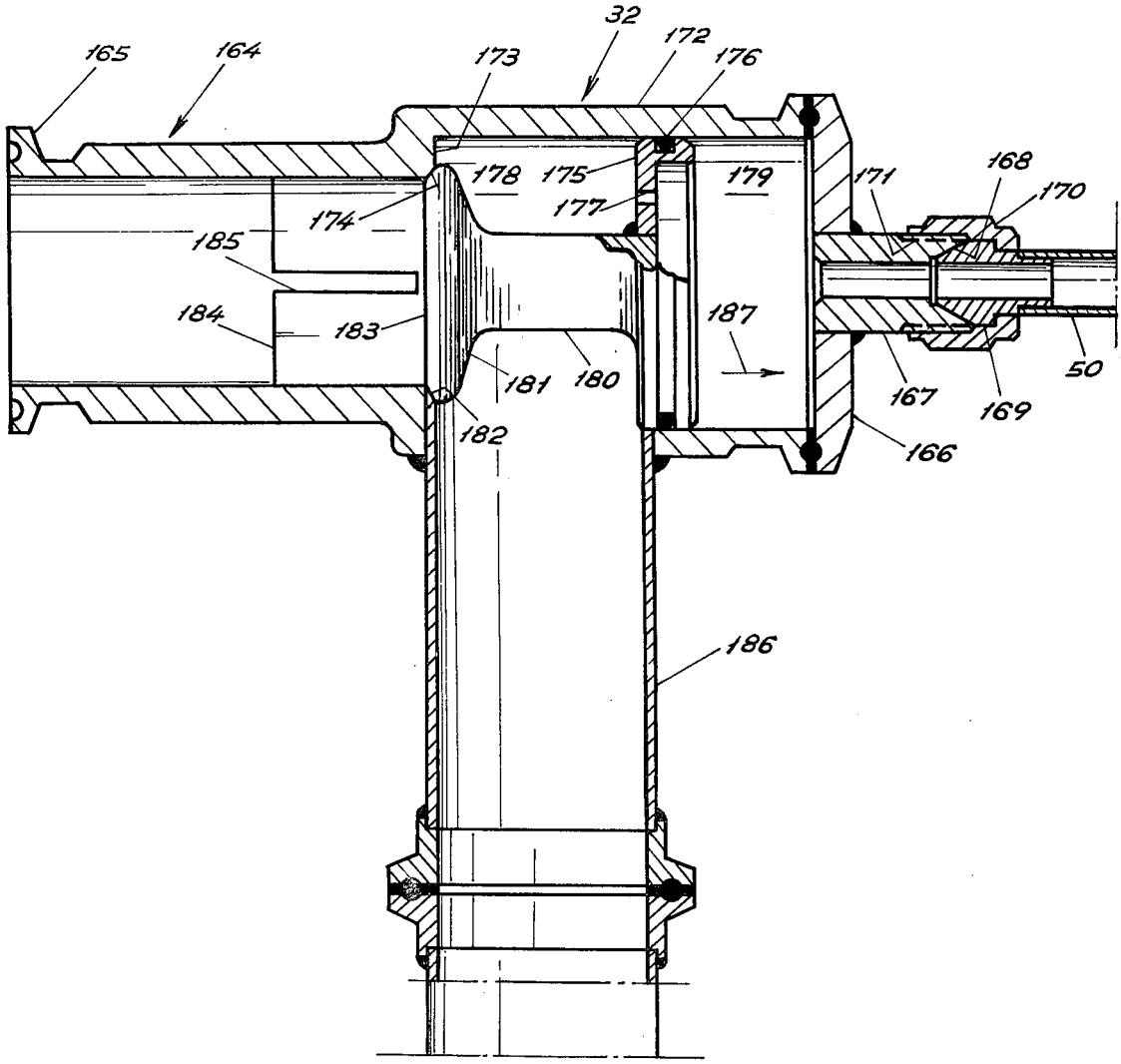
FIG. 9 is a side elevation cross-section showing one type of valve for the control of the final product output flow rate supplied by the corresponding pump and which is remotely controllable by the hydraulic control valve of FIG. 8.

FIG. 9 shows a side elevation cross-section of the final product flow rate control valve 32. This valve comprises a body 164, one end 165 of which is the outlet of the final product (31 in FIG. 1). The other end of body 164 is provided with a cover 166 which has a short conduit 167 its outlet being inwardly conical to receive a complementary conical connecting nipple 169 to which is connected the hydraulic control conduit 50 (see also FIG. 1). Nipple 169 fits tightly against its seat 168 by means of a cap 170 connected by means of a screw thead 171 to the exterior of the short conduit 167. Body 164 has a portion of greater diameter 172 providing an internal shoulder 173 forming a seat 174. Within the portion of greater diameter 172, close to the end carrying the cover 166, there is provided a piston 175 which is longitudinally slidable within conduit 172 providing a slidable sealing contact with the internal wall of the latter by means of a sealing ring 176. Piston 175 has an orifice 177 which communicates space 178 (corresponding to the inner space of conduit 172) with the space 179 (formed between the upper face of piston 175 and cover 166). Piston 175 has a piston rod 180 ending with a valve head 181 having a lower face provided with a sloping edge 182 capable of seating on the seat 174. To the lower face 183 of valve head 181 is fixed a sleeve 184 which is longitudinally slidable within body 164 providing a fluid seal with the inner wall of the latter. Sleeve 184 is provided with at least one longitudinally slot 184 on its periphery. Into space 178 of body 164 discharges conduit 186 connected to the exhaust 30 of centrifugal pump 29 (see also FIG. 1). According to FIG. 9 it can be seen that when piston 175 moves within space 179 in the direction indicated by the arrow 187, the sleeve 184 moves in the same direction within the body 164; thus slot 185, when it is moved gradually more and more into space 178, establishes a gradually increasing communication between the space 178 and the final product outlet 165, thus metering the amount of product which will be supplied by the apparatus.

The embodiment of the apparatus of this invention shown in FIG. 1, has also means allowing a fast and complete cleaning of storage tanks 1 and 3, the first of which contains only sirup, and the second containing the sirup and water mixture. Storage tank 2 does not need cleaning means, since it must contain only water. As can be seen in FIG. 1, a two-way valve 188 is connected to a conduit 189 which is selectively connectable (by means not shown in FIG. 1) to a drainage pipe line or to a pressurized washing liquid source. When conduit 189 is connected to the drain and the two-way valve 188 is directed to the additional centrifugal pump 29 (conduit 190 being closed-off), centrifugal pump 29 will be drained and, through this latter, additional tank 3 will also be drained; when conduit 189 is connected to the pressurized washing liquid source (which can be only, or water with some additive or additives and the conduit leading from centrifugal pump 29 to valve 188 is closed-off, the washing liquid under pressure will flow through conduit 190 which divides into two other conduits 191 and 193, the first of which feeds a spraying nozzle 192 which sprays the pressurized washing liquid in all directions into storage tank 1, and the other feeds another spraying nozzle 194, similar to nozzle 192, which sprays the pressurized washing liquid in all directions into additional tank 3. Centrifugal pumps 19 and 35 can be drained by means of the draining taps 195 and 196; when the pumps are in an inoperative condition, the same draining taps allow the drainage by gravity of storage tanks 1 and 2, respectively.

Figure 10:
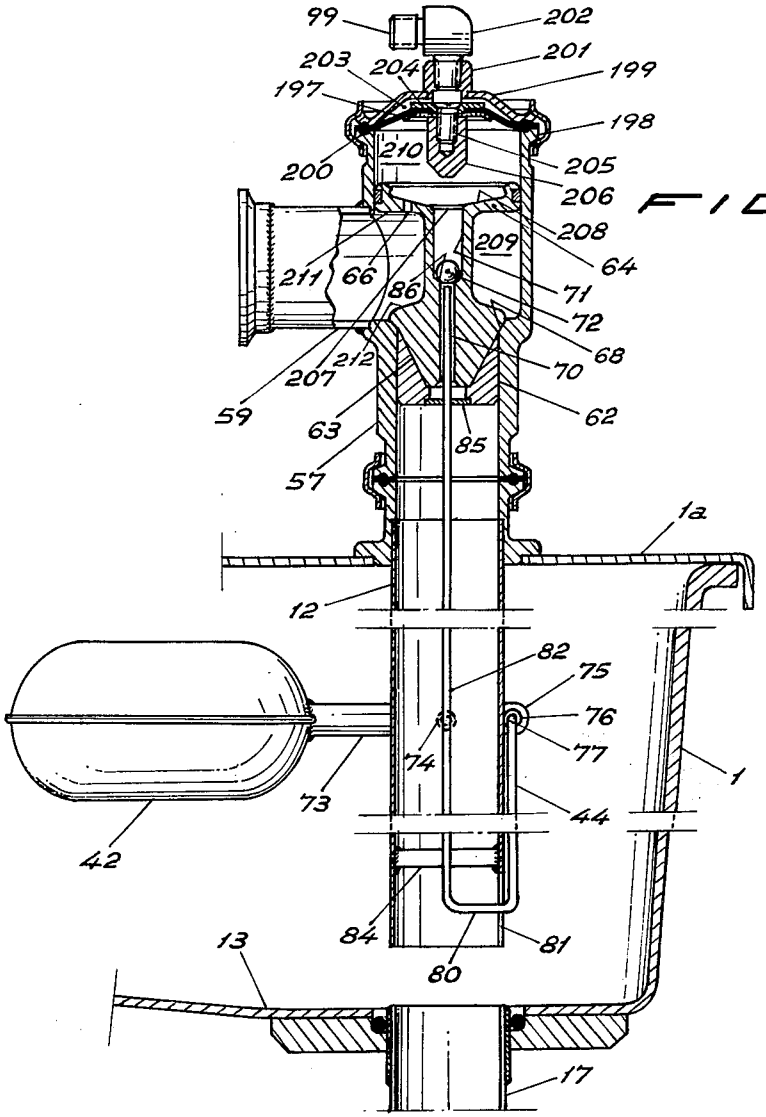
FIG. 10 is a side elevation cross-section, similar to FIG. 3A, of another embodiment of an intake control valve.

FIG. 10 shows a side elevation cross-section of another embodiment of an intake control valve like the already described valves 4 and 5 of FIG. 1 and illustrated in detail in FIG. 3A. Notwithstanding, it differs from the embodiment of FIG. 3A by the fact that its remote hydraulic control portion is mechanically more simple and effective. In the upper part of the valve of this embodiment there is provided a flexible diaphragm 197 the periphery thereof being clampled between an outwardly directed flange 198 of the valve body and the edge of a cover 199 with the interposition of a seal ring 200. Cover 199 is provided with a short output conduit 201 receiving a fitting 202 to which is connected the pressurized hydraulic liquid conduit 99. When diaphragm 197 is in its illustrated position, that is to say in absence of pressurized hydraulic control liquid, the diaphragm will be in its substantially raised position, remaining between the diaphragm and the cover 199 an only very small space 203 due to the presence of a washer 204 provided above the diaphragm and which serves at the same time to receive, without damaging the diaphragm, a fixing screw 205 used to fix to the diaphragm a pusher member 206 the lower end of which has a conical form which is complementary with a seat 207 of the upper side of piston 64. When pressurized hydraulic control liquid is applied to conduit 99, the liquid flows into space 203 and pushes downwardly the diaphragm 197, seating the lower end of pusher member 206 onto the seat 207 and pushing downwardly the piston 64 and the valve member 63 which will make contact with its seat 68. In FIG. 10 can be seen the radially outwardly and upwardly tapering of the upper face 208 of piston 64. So, if the valve ball 72 jumps higher than the upper face 208 of the piston, it can fall again easily by gravity into the chamber 71. With the exception of what has been thus far described, the construction of the remaining portion of this embodiment of the valve is similar to that of the embodiment of FIG. 3A.

The operation of the apparatus of this invention will now be described with reference to an embodiment like that of FIG. 1 which is usable for mixing two different liquids, like sirup and water, as in the manufacturing of gaseous beverages. The skilled in the art, after having read the description of the operation of the embodiment of FIG. 1, will be able to easily understand the operation of the embodiment of FIG. 2, since this latter is only a simplification thereof, with the exception of some minor differences which will be specifically explained later on.

First of all the flow by gravity or by pumping pressure of the liquids will be allowed from their respective reservoirs to the intake control valves 4 and 5, which will be assumed to be of the type shown in FIG. 10. In the case of valve 4, the liquid will flow, through conduit 7 and input 6, into chamber 209 filling it. Since the storage tank is initially empty, float 42 will be in its lower position and thus rod 47 will maintain the valve ball 72 out of contact with its seat 86, so that the liquid flowing from chamber 209 will fill chamber 210 through the orifice 66, and will be drained through channel 70 flowing into the storage tank 1 without exerting any noticeable downwardly pressure onto the lower face 211 of piston 64. Since the lower face area of piston 64 is lesser than the area of the sloping upper face 212 of the valve member 63, the liquid pressure in chamber 209 will push upwardly the valve member 63 and piston 64 assembly unseating the valve member 63 from its seat 68, so that the liquid may flow now freely from the input 6 to chamber 209 and will drain from this latter, through the open space between the valve member 63 and its conical seat 62 and therefrom through conduit 12, to storage tank 1 filling it progressively. As the liquid level rises in the storage tank 1, float 42 will also rise progressively so that it will bring rod 47 downwardly until valve ball 72 makes contact with its seat 86 resting thereon and closing channel 70. When this happens, the pressure of the liquid in chamber 210 will increase pushing downwardly piston 64 and valve member 63 until this latter makes contact with its seat 62 and closes communication between chamber 209 and conduitt 12. The closure takes place when the liquid in storage tank 1 has reached the preestablished level. An identical process takes place in the case of storage tank 2 with its intake control valve 5 and its float 43. When both storage tanks 1 and 2 have been filled to their optimum operative level, motor 41 will be started simultaneously putting in operation both centrifugal pumps 19 and 35 which begin to withdaw liquid from storage tanks 1 and 2, sending it to the mixer section 24 in the exactly predetermined proportions fixed by the metering orifice plate 22 and the micrometrically adjustable metering orifice device 38. Both liquid streams, the first of which will have acquired a rotatory flow movement in mixer section 24, will meet at the output of this latter and will flow into conduit 23 intimately mixing and this mixture will flow into additional tank 3 through downwardly directed conduit 25. At the same time, the operation of additional centrifugal pump 29 will withdraw the mixed liquid product from additional tank 3 through conduit 27 and will supply it under pressure to the final product outlet 31, previously passing through final product discharge control valve 32. Float 48, hydraulic control valve 49, hydraulic control conduit 50 and final product discharge valve 32 have the purpose of maintaining constant the level of the mixed liquid in additional tank 3. This stabilization of the level takes place in the following way. When additional pump 29 withdraws an excessive flow from additional tank 3, the liquid level in said tank will go down progressively, and so will float 48. Thus (see also FIG. 8), end 153 of flaot arm 152 will rise pushing up valve member 154 which pushes up its conical portion 156 against its seat 156' closing the fluid path. Pressure will rise in conduit 50 and thus also within chamber 179 (see FIG. 9) pushing up piston 175 in a direction opposite to the direction of arrow 187 and thus a progressively greater area of slot 185 will be closed as fluid pressure rises within chamber 179, so that there will be a lesser flow of liquid from conduit 186 to the final product outlet 31. Thus a lesser amounts of liquid will be withdrawn from additional tank 3 and, being constant the liquid input to the latter through conduit 25, the liquid level within tank 3 will rise progressively, the float 48 going up until a point is reached at which the process will reverse so that valve 32 will allow again a greater output flow rate of the final product through final product outlet 31. The control system for the liquid level within tank 3, that is to say the combination of hydraulic control valve 49 and final product discharge control valve 32, is a highly sensitive one so that during the operation of the present apparatus the liquid level within additional tank 3 will fluctuate within very narrow limits.

A very important feature of this invention is the axial alignment of the outlet of conduit 12 with the inlet of conduit 17 within storage tank 1, of the outlet of conduit 15 with the inlet of conduit 33 within storage tank 2, and of the outlet of conduit 25 with the inlet of conduit 27 within additional tank 3. This axial alignment of the said conduits allows a really minimum degree of turbulence within tanks 1, 2 and 3, without the use of devices such as baffle plates and the like. Turbulence within said tanks is undesirable because it makes difficult to maintain an accurate level within the same.

Another highly important feature of this invention is the fact that pumps 19 and 35 (and other pumps in the case that there are provided more than two storage tanks) are driven synchronously by a single rotatory power source (electric motor in the present instance) which is common to all the pumps. This allows that the proportions of both liquids streams will be maintained as accurately constant as possible. The proportions of the streams will also be maintained constant during the starting period of the apparatus and during its shut-off period. That is to say, the proportions of the streams will remain constant for any r.p.m. pf the pumps (from zero to maximum), even in the case of changes of speed of motor 41 due to variations of the supply voltage, specially if an asynchronous alternating current motor is used.

To adjust the proportions of the components of the liquid mixture, the speed of all the pumps like 19 and 35 being the same, there must be provided means to predetermine said proportions of each of the liquid streams with respect to the other or others. One of the liquid streams is taken as a reference (preferably the one that has the greatest viscosity; the sirup in the present case) and the metering orifice plate 22, having an orifice accurately calibrated, is used to secure that pump 19 will supply the mixer section 24 and the additional tank 3 with a fixed flow rate of this liquid component of the mixture. The flow rate of the other stream of liquid which is supplied to the mixer section 24 and to additional tank 3 is adjustable with great accuracy, with respect to the reference flow rate mentioned above, by means of the micrometrically adjustable metering orifice device 39. This combination of a fixed metering orifice and a micrometrically adjustable orifice will secure that the mixture supplied to additional tank 3 will constantly comprise the exact proportions of both liquids of the final mixture.

If for any reason, notwithstanding the level control means provided, an excessive rise or lowering of the liquid level takes place in one or simultaneously in two or more of the tanks, the maximum level and the minimum level control electrodes 51, 53 and 55, and 52, 54 and 56, respectively, will enter in action. If the level in one tank would rise up to the lower end of the maximum level control electrode, this latter will produce a signal which, by means of electrical or electronic means, will stop completely the operation of the apparatus and this condition will be maintained until the fault has been corrected. The same process will take place if the level in one or more tanks would diminish down to the lower end of the corresponding minimum level control electrode, this electrode also producing a signal which will stop the operation of the apparatus.

The operation of the embodiment shown in FIG. 2 is similar to that already described for the embodiment of FIG. 1 but with the following differences. In the embodiment of FIG. 2, the mixer section 24, the additional tank 3 and the additional centrifugal pump 29 of FIG. 1 are not used, and thus the hydraulic control valve 49 and the final product flow rate control valve 32 are not necessary and therefore are omitted. The flow rates supplied by pumps 19 and 35 goes to the final product output 31 through the metering orifice plate 22 and the micrometrically controllable metering orifice device 38. Aside from this, the construction and operatioan of the apparatus are the same as described for the embodiment of FIG. 1.

Thus the advantages of the present invention in front of the prior art reside in that it will allow to obtain a final product which comprises accurate proportions of each of the component liquids, prefectly and homogenously mixed, and there proportions will be maintained with great accuracy not only during the starting and stopping periods, but also during the entire period of operation, even if this is very long. This is the consequence of the use of pumps (like pumps 19 and 35) which are all driven by the same single motive power source, the axial alignment of the output end of the input conduit with the input of the output conduit in each of the tanks avoiding turbulence of the liquid therein, and the use of the fixed and the micrometrically adjustable metering orifices, all this even more improved by the use, in the embodiment of FIG. 1, of the hydraulic negative feedback provided by the additional centrifugal pump 29, the additional tank 3, the hydraulic control valve 49 of the additional tank and the final product output flow rate control valve 32.

Anybody skilled in the art will be able to easily understand this invention after having read the preceding specification. It will also be understood that this invention must not be interpreted as being limited to the specific embodiments nor to the specific details nor to the specific arrangement of its component elements here described and illustrated, which have only be given as illustrative and non limitative examples, it being possible to introduce changes and modifications which will be obvious in the light of what here has been described and illustrated, and which will be within the true scope of the invention as defined in the following claims.

I claim:

1. A metering and mixing apparatus for a plurality of liquids each supplied from a respective source, the machine comprising a plurality of storage tanks, one for each of the liquids to be mixed; a first supply conduit for each of said tanks, each supply conduit having an inlet connected to a respective source of the corresponding liquid to be mixed, and an outlet discharging downwardly into the respective tank from the upper part thereof, said first conduit reaching down to a comparatively short distance from the tank bottom, and a second output conduit for each of said tanks and having an inlet and an outlet, this inlet being connected to the bottom of the corresponding tank substantially in axial alignment with the outlet of said first conduit, a liquid pump for each tank and having an intake and an exhaust, this intake being connected to the outlet of said corresponding second output conduit; a third discharge conduit for each of said pumps, said exhaust of each pump being connected to the inlet of the corresponding third discharge conduit which is provided with an outlet; a single fourth mixed product output conduit having a plurality of inlets each connected to one of the outlets of said third discharge conduits; an interchangeable metering orifice plate arranged within the flow path between one of said third conduits and said fourth conduit, said plate being interchangeably mounted to allow its replacement by other plates having metering orifices of different size, and a micrometrically adjustable metering orifice device arranged between each of the remaining third conduits and said fourth conduit, an intake control valve for each of said first conduits, a float arranged in each tank and mechanically linked to its corresponding intake control valve for closing said intake control valve when the liquid in said tank rises above a predetermined level, and a single drive means for all said liquid pumps.

2. An apparatus according to claim 1, further comprising an additional tank for containing the mixed liquids said fourth conduit discharging downwardly, through an outlet, into said additional tank from the upper part thereof, said fourth conduit reaching down to a comparatively short distance from the additional tank bottom; a fifth conduit having an inlet and an outlet, said inlet being connected to the additional tank bottom substantially in axial alignment with the outlet of said fourth conduit; an additional liquid pump having an intake connected to the outlet of said fifth conduit and an exhaust connected to the mixed liquid product outlet.

3. An apparatus according to claim 2, further comprising two storage tanks, said fourth conduit comprising a mixer section having a first external tubular body and a second internal tubular body concentrically mounted within said first tubular body, a chamber being formed between the external wall of said second body and the internal wall of said first body, helicoidally formed blades mounted within said chamber, said blades defining at least one helicoidal path capable of communicating a rotational movement to the flowing liquid about the geometrical axis of said mixer section, the interior of said second body being communicated with the third conduit provided with said interchangeable metering orifice plate, and said chamber formed between said first and said second bodies being communicated with said third conduit provided with said micrometrically adjustable metering orifice device, and the interior of said second body, as well as the space formed betwen said first and said second bodies, discharging into the remaining portion of said fourth conduit.

4. An apparatus according to claim 2, wherein said additional tank comprises a float, a mounting arm for said float, an hydraulic control valve mechanically linked to this mounting arm so the valve is closed when the liquid in said additional tank drops below a predetermined level; a mixed liquid product output flow control valve arranged between the exhaust of the additional liquid pump and said mixed liquid product outlet; said hydraulic control valve is communicated with the interior of said additional tank and is connected to the control member of said output flow control valve through an hydraulic control conduit, said hydraulic control valve opening when the liquid in said additional tank raises above a predetermined level, allowing the flow of liquid from said output flow control valve to said additional tank and thus allowing a greater liquid flow from the exhaust of said additional liquid pump to said mixed liquid product outlet.

5. An apparatus according to claim 4, wherein said hydraulic control valve comprises a manual actuating knob capable of carrying said hydraulic control valve, under manual pressure, to its open condition.

6. An apparatus according to claim 5, wherein each of said intake control valves has a pressure sensitive member comprising an hydraulic fluid pressure actuatable piston, the supply of hydraulic fluid to said piston being manually controllable so that, when hydraulic fluid is applied to the piston, this latter is capable of pushing the valve closure member to its closed condition.

7. An apparatus according to claim 5, wherein each of said intake control valves has a pressure sensitive member comprising an hydraulic fluid pressure actuatable diaphragm, the supply of hydraulic fluid to said diaphragm being manually controllable so that, when hydraulic fluid is applied to the diaphragm, this later is capable of pushing to valve closure member to its closed condition.

8. An apparatus according to claim 6, wherein the closure member of each of said intake control valves comprises a longitudinally movable body which has formed in its lower end a conical enlargement seatable in a seat provided in the output of said valve, when the same is in its closed condition, said body being provided in its upper end with a piston longitudinally movable in a cylinder portion of the valve and said piston having an orifice of comparatively small diameter capable of communicating both sides of the piston, said body having a longitudinally axial channel which has a lower portion of lesser diameter and an upper portion of greater diameter, a valve ball being provided within the greater diamemter portion of said channel, said valve ball being adapted to become seated on the shoulder formed by the transition between said portions of greater and lesser diameter of said channel, said valve ball closing the longitudinal channel in its seated condition, the mounting arm of the float of the corresponding storage tank being linked to an actuating rod projecting into said portion of lesser diameter of the longitudinal channel of the longitudinally movable body of the valve, the end of the rod projecting into said channel being adapted to lifting the valve ball from its seat when the liquid in the corresponding storage tank drops below a predetermined level.

9. An apparatus according to claim 8, wherein a filtering and deaerating device is interposed between the intake control valve of one of the storage tanks and a corresponding liquid reservoir.

10. An apparatus according to claim 9, wherein a pair of electrodes is provided in at least one of the tanks for switching off the apparatus when the liquid therein rises above a first predetermined level and when it drops below a second predetermined level.

11. An apparatus according to claim 10, wherein at least one of said tanks is provided with at least one nozzle for spraying pressurized liquid to wash the corresponding tank when it is empty of liquid.

12. An apparatus according to claim 11, wherein drainage means are arranged at the lowest point of the flow of liquid through the machine.

13. An apparatus according to claim 12, wherein drainage means are arranged at the lowest point of the flow of liquid through said additional pump.

14. AN apparatus according to claim 13, wherein said hydraulic control valve has a closure member mechanically linked with the mounting arm of the float of said additional tank allowing the seating of said closure member on its seat when the liquid in said additional tank drops below a predetermined level.

15. An apparatus according to claim 14, wherein said manual actuatable member of the hydraulic control valve has a control knob connected to a stem capable of abutting said valve closure member unseating it from its seat when said control knob is pressed, and a returning spring biasing said knob to its normal rest position.

16. An apparatus according to claim 15, wherein said mixed liquid product output flow control valve comprises a body with a piston lingitudinally slidably mounted therein and dividing said body in two chambers intercommunicated through an orifice provided in said piston, the first chamber, corresponding to the upper face of the piston, being communicated with said hydraulic control valve through said hydraulic control conduit, said piston being linked to a closure member seatable on a seat provided by said body, said closure member carrying a sleeve longitudinally slidably mounted within said body opposite to said seat and the wall of said sleeve being provided with at least one longitudinal slot, the other of said chambers being connected to the exhaust end of said additional liquid pump and the open end of said sleeve opening to said mixed liquid product outlet.

17. AN apparatus according to claim 16, wherein each of said interchangeable metering orifice plates has a length which is substantially more than twice the diameter of the conduit in which it is introduced, each of these plates being provided with two orifices or different diameters so that when the plate is slid into the corresponding conduit with one of its ends first, one of said orifices will be interposed in the flow path of the conduit, and when the plate is slid into the conduit with its other end first, the second of said orifices will be interposed in said flow path.

18. AN apparatus according to claim 17, wherein said micrometrically adjustable metering orifice device comprises a body within which is mounted a sleeve having a least one longitudinal slot defined in the wall thereof, and further compresing a plunger member longitudinally slidably arranged in said sleeve, said plunger member having an outside diameter substantially equal to the inside diameter of the sleeve, said plunger member being mechanically linked with the micrometrical control mechanism, a progressively greater portion of said slot being uncovered when said plunger member is moved backwards thus allowing progressively greater liquid flow rates through the device.

* * * * *